US006067781A

United States Patent [19]

Ford et al.

[11] Patent Number: 6,067,781

[45] Date of Patent: May 30, 2000

[54] SADDLE PAD

[76] Inventors: Dan Rufus Ford, 2190 Hartford Rd.; Barry Stephen Ford, 2175 Hartford Rd., both of Cosby, Tenn. 37722

[21] Appl. No.: 09/177,459

[22] Filed: Oct. 22, 1998

Related U.S. Application Data

[63] Continuation-in-part of application No. 08/906,022, Aug. 5, 1997, abandoned.

[51] Int. Cl.[7] ..... B68C 1/12

[52] U.S. Cl. ..... 54/66

[58] Field of Search ..... 54/44.7, 65, 66, 54/79.4

[56] References Cited

U.S. PATENT DOCUMENTS

| | | | |
|---|---|---|---|
| 1,127,748 | 2/1915 | Faurot | 54/65 |
| 3,314,122 | 4/1967 | Bundy | 28/1 |
| 3,323,287 | 6/1967 | Hilmer | 54/66 |
| 3,686,049 | 8/1972 | Manner et al. | 156/167 |
| 3,971,194 | 7/1976 | Morgan | 54/66 |
| 4,252,590 | 2/1981 | Rasen et al. | 156/167 |
| 4,351,683 | 9/1982 | Kusilek | 156/167 |
| 4,524,570 | 6/1985 | Racinet | 54/66 X |
| 5,177,940 | 1/1993 | Paul . | |
| 5,191,752 | 3/1993 | Murphy | 54/44.5 |
| 5,456,072 | 10/1995 | Stern | 54/44.5 |
| 5,456,876 | 10/1995 | Redwine et al. | 264/555 |
| 5,555,710 | 9/1996 | Smith | 54/66 |
| 5,575,139 | 11/1996 | Green | 54/66 |

FOREIGN PATENT DOCUMENTS

| | | |
|---|---|---|
| 78-19705 | 6/1978 | Japan . |
| 80-8623 | 3/1980 | Japan . |

*Primary Examiner*—Robert P. Swiatek
*Attorney, Agent, or Firm*—Luedeka, Neely & Graham, PC

[57] ABSTRACT

An equine saddle pad for use in direct contact with the animal's hide and hair is constructed from a mat of piled polymer filaments extruded into an elongated continuity of about ½ inch thickness having 65% to 80% void volume within a thermally bonded matrix of approximately 10 mil to 30 mil diameter filaments. In one alternative embodiment of the invention, a hinge band of reduced thickness and void volume is heat formed along the pad center to divide the pad into two substantially symmetric leaves. Another alternative embodiment comprises a unitized overlay of the polymer filament pad by a dissimilar material such as neoprene foam, felt, woven nylon, woven or knitted polyester, cotton, wool or linen.

14 Claims, 6 Drawing Sheets

SADDLE PAD

CROSS-REFERENCE TO RELATED APPLICATION

The present application is a continuation-in-part of U.S. patent application Ser. No. 08/906,022 filed Aug. 5, 1997 and now abandoned.

BACKGROUND OF THE INVENTION

The present invention relates to equine tack and more particularly, to an equine saddle pad.

Traditionally, saddles for horseback riding have been secured over one or more blankets of coarse, raw wool. The blanket is spread over the horse's back to basically cover those areas contacted by the saddle and usually the stirrup straps. The primary function of the blanket is protection of the mount from chafing and abrasion caused by the saddle and straps. Secondarily, the blanket provides a cushioning function for both the horse and the rider. Additionally, the blanket offers a small degree of wicking to remove the horse's perspiration and admit a small degree of air ventilation between the horse's back and the saddle.

As a natural material, fresh raw wool performs the saddle blanket function reasonably well. Natural oils in the wool resist moisture saturation. Even though wet with perspiration wicked from the horse's back, the wool fibers sustain a large degree of resilience and openness to ventilation.

However, as a natural animal hair, wool also harbors and even sustains bacteria, fungus and mildew. The usual sanitation practice of washing the blanket with soap and water also removes the protective natural oils from the fiber, thereby reducing the primary advantages of wool. Once these natural oils are removed from the wool fiber, water is absorbed and the wet resilience is lost.

Numerous synthetic materials have also been used for saddle pads and blankets including fabrics woven from polyester and other similar materials. Also, elastomer foams such as polyether, polyurethane and polyurethane foams have been used. Although each of these materials have particular strengths or advantages relative to natural raw wool, none have a combination of properties comparable to wool. For example, a closed cell foam provides excellent resilience but almost no moisture wicking or ventilation capacity. Woven synthetic materials have little resilience or moisture wettability. Consequently, synthetic fiber has but small moisture wicking properties.

It is therefore an objective of the present invention to provide a synthetic material saddle pad having a high degree of air ventilation and wettability for moisture drainage.

Another object of the invention is a saddle pad that remains resilient when wet.

Another object of the invention is a saddle pad that drains perspiration from the horse's back without saturating the pad fibers.

Yet another object of the invention is a saddle pad that does not absorb the horse's perspiration.

Still another object of the invention is a saddle pad that may be sanitized with soap and detergent without consequence of functional deterioration such as resilience.

Another object of the invention is a saddle pad that quickly dries after washing.

And another object of the invention is a highly flexible saddle pad that easily conforms to the horse's contours.

Another object of the invention is a saddle pad that is slip resistive between both the horse's back and the saddle thereby assisting the saddle girth function and to better secure the relative position of the saddle on the horse, especially in steep terrain riding.

As an incident of the foregoing invention object, extreme saddle girth tension on the horse for steep terrain and rapid turn riding is reduced if not eliminated.

A further object of the invention is a saddle pad of synthetic material that does not sustain bacteria or fungus.

Also an object of the invention is a saddle pad that sheds or drains the horse's perspiration away from the horse and rider.

No less an object of the invention is a saddle pad having a high degree of adherence to the back of a horse and more particularly, to the back of a wet horse.

It is also an object of the invention to provide a riding pad useful for both saddle seating and bareback riding.

These and other objects of the invention to be described hereafter by the drawings and detailed description, are accomplished by a saddle pad formed from a nonwoven mat of soft, flexible, extruded filaments of polymer such as low density polyvinyl chloride. In the preferred embodiment, the saddle pad mat is a continuous, randomly piled accumulation of extruded filament about ½ inch thick.

The polymer filaments are about 10 mil to about 30 mil in nominal diameter and are extruded from a gangplate of orifices about 12 to 26 mils in diameter. These filaments fall upon a moving surface landing area that carries the accumulation from the loading area at a rate coordinated to the filament delivery rate to produce a continuous web of about ½ inch and about 65% to about 80% void volume.

The mat is cut to the configuration of the intended saddle or riding style, whether Spanish, western or continental. Down the center of the pad along the line of the horse's spine, an approximately 1-inch wide strip of material is partially heat fused from at least the top side of the pad. Desirably, a ½-inch wide band around the perimeter is also fused, both top and bottom.

In use, the smoother pad surface is placed directly against the horse's back and the saddle secured directly over the pad. If desired, however, a conventional wool or cotton saddle blanket may be placed between the pad and saddle.

BRIEF DESCRIPTION OF THE DRAWINGS

The above and other features and advantages of the invention will be better understood from the following detailed description of the preferred embodiments of the invention when examined in conjunction with the accompanying drawings in which.

DESCRIPTION OF THE PREFERRED EMBODIMENTS

Figure 1:
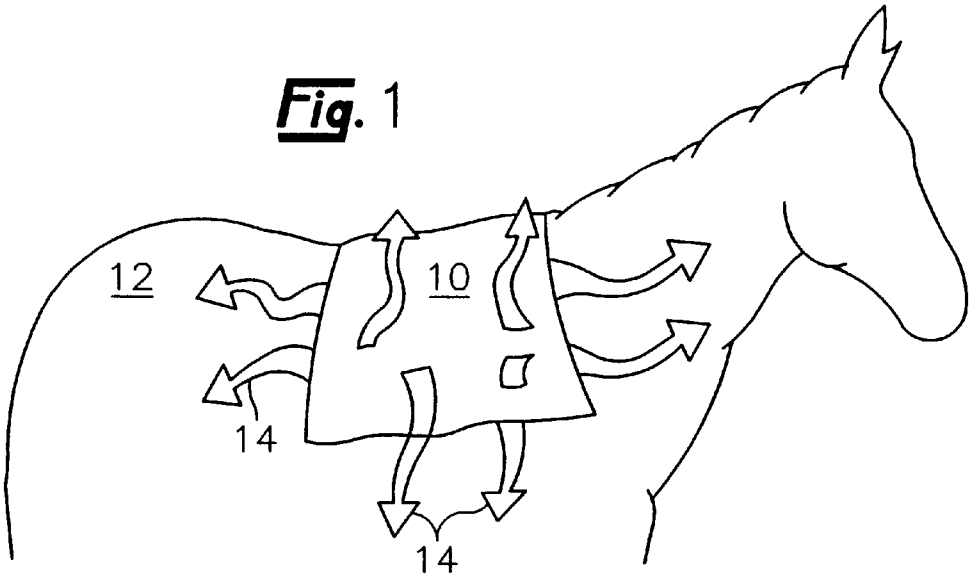
FIG. 1 is a pictorial diagram of the invention.

Relative to the drawings wherein like reference characters designate like or similar elements throughout the several figures of the drawings, the diagram of FIG. 1 illustrates a rectangular configuration of the invention saddle pad 10 draped across the back of a horse 12. Arrows 14 are representative of the multiple air flow directions through the pad 10 inclusive of top to bottom, bottom to top and laterally from the perimeter edges. Because of a large, 65% to 80% void volume having virtually 100% permeability, atmospheric gas filling the void labyrinth around the randomly piled fibrous substance of the pad 10 is easily pumped through and around the pad by the multiple, repeated and localized compressive displacements of the pad in use.

The material substance of the pad 10 is a product corresponding to that produced by Plastic Floor Mats, Inc., of Knoxville, Tenn. and more particularly described by U.S. Pat. No. 5,456,876. A similarly useful product is described by U.S. Pat. No. 4,351,683. Briefly, the pad 10 material is a random piling of continuously extruded thermoplastic polymer filaments. Typically, polyvinyl chloride is extruded at about 300° F. to about 325° F. from a multiplicity of 0.012 inch to 0.026 inch orifices in an a orifice plate. In free fall from the orifice plates, the polymer filaments neck down to a filament diameter of about 0.010 inch to about 0.030 inch. This multiplicity of viscous polymer filaments is aligned to issue as a falling curtain landing upon the surface of a slowly rotating cylinder turning at a coordinated rate to accumulate about ½ inch of piled thickness before rotation of the cylinder moves a cylinder landing area away from the descending filament curtain. Preferably, the cylinder has a moderately rough surface texture, as with an 80 grit emery cloth, to hold the resulting mat tightly to the landing cylinder for the desired rotational arc necessary for initial cooling.

The operative result of the above process and apparatus is a continuously emerging mat of about ½ inch thickness having a specific gravity of about 1.30, a hardness of about 70-A Durometer and a void volume of about 65% to about 80%. That surface of the mat directly engaging the landing cylinder surface is usually of a more coarse or rough texture than the opposite or free air surface. The extrusion temperature range of about 300° F. to about 325° F. induces a thermally bonded or heat fused joint at each contact crossing of the filaments as the pile accumulates. Hence, the mat structurally integrates as a composite matrix around an open, labyrinthine void volume of about 100% permeability.

Figure 7:
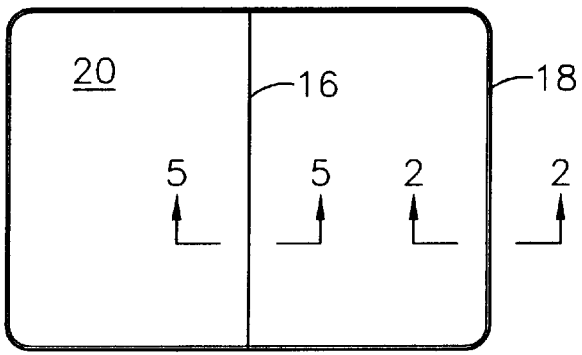
FIG. 7 is a plan view of the rectangular configuration of the invention.
Figure 6:
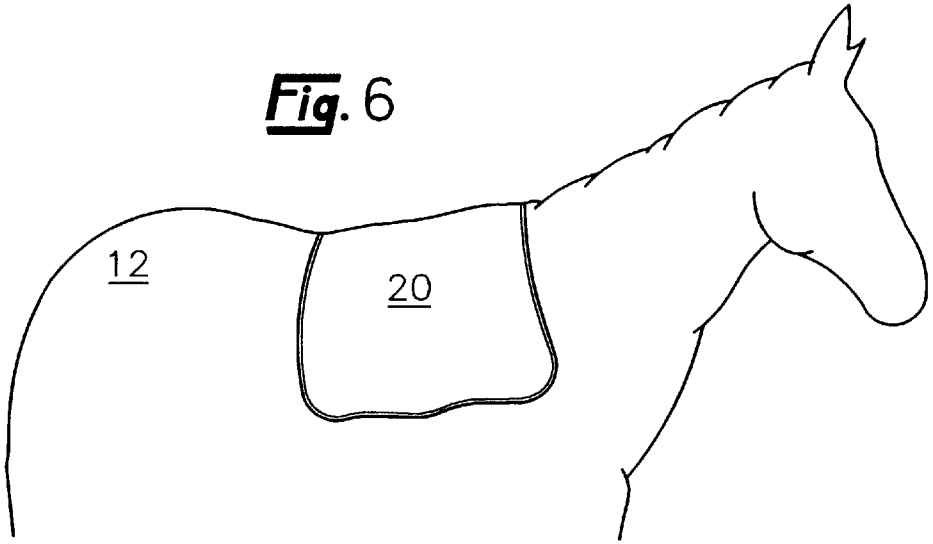
FIG. 6 is a pictorial view of the rectangular configuration of the invention.
Figure 5:
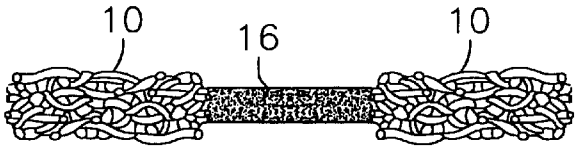
FIG. 5 is an end section of the invention as viewed along cutting planes 5—5 and FIGS. 7, 9 and 11.
Figure 8:
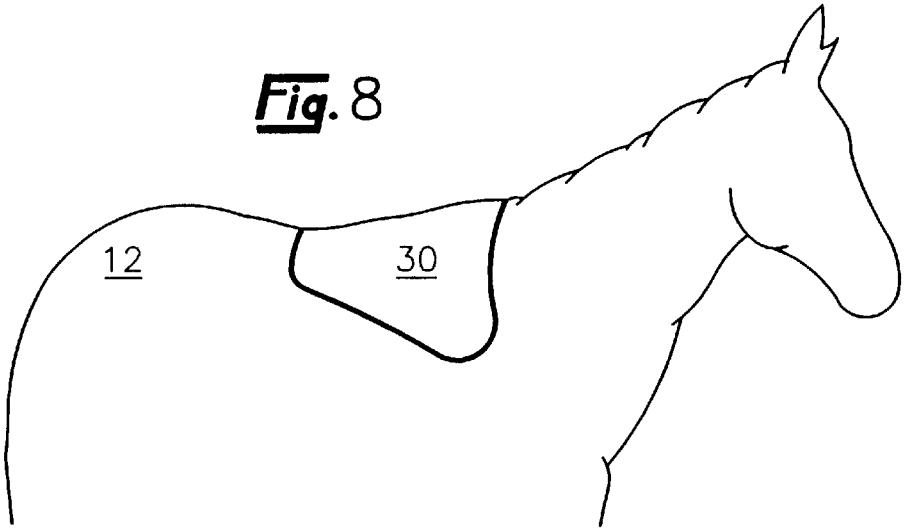
FIG. 8 is a pictorial view of the continental configuration of the invention.
Figure 9:
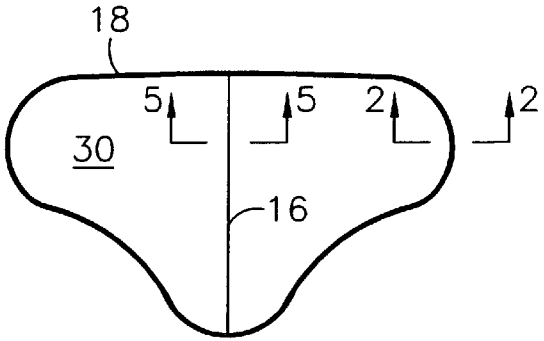
FIG. 9 is a plan view of the continental configuration of the invention.
Figure 10:
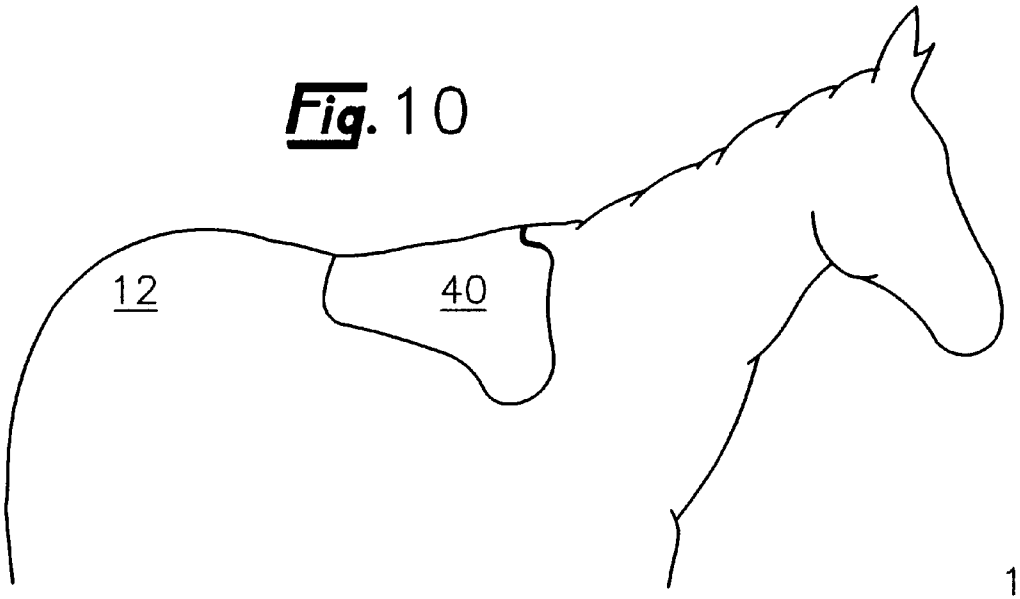
FIG. 10 is a pictorial view of the Spanish configuration of the invention.
Figure 11:
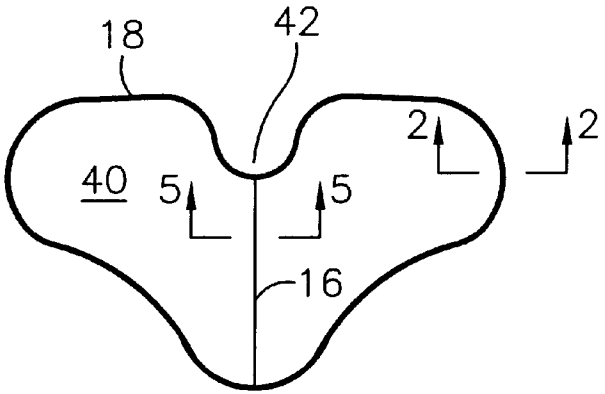
FIG. 11 is a plan view of the Spanish configuration of the invention.

A segment of this mat is cut to a desired saddle pad shape such as the rectangular western shape 20 of FIGS. 6 and 7, the triangular continental shape 30 of FIGS. 8 and 9 or the Spanish shape 40 of FIGS. 10 and 11. In the absence of other reference markings on the pad, one or more hinge bands 16 may be formed along the pad centerline lying adjacent to the horse's spine to essentially divide the pad 10 about the horse's spine into two laterally symmetric leaves. These bands of about ½ inch to about 2 inches width and about ¼ inch to about ⅜ inch thickness are formed by localized heat fusion which sufficiently plasticizes the polymer filaments to induce collapse of the void volume therewith. Such a hinge band greatly assists symmetric positioning of the pad over the horse's back. The hinge is simply aligned with the ridge of the horse's spine. This feature is especially useful for small riders that may not be able to see the spine ridge when they saddle the animal. The hinge band 16 may be aligned with the horse's spine by feel alone. The same is true for riders of any size that saddle one of the large work or warhorse breeds. As illustrated by the end section of FIG. 5, the hinge band 16 is substantially centered between opposite surface planes of the pad 10. However, the hinge may also be formed entirely from either surface plane thereby providing a continuous surface over either top or bottom surface as desired. Furthermore, the singular, centralized hinge band shown by the drawings may be replaced by two or more narrow, parallel hinge bands.

Figure 2:
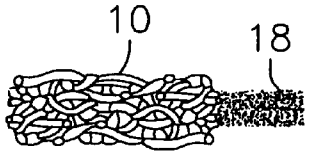
FIG. 2 is an end section of the invention as viewed along cutting planes 2—2 and FIGS. 7, 9 and 11.
Figure 3:
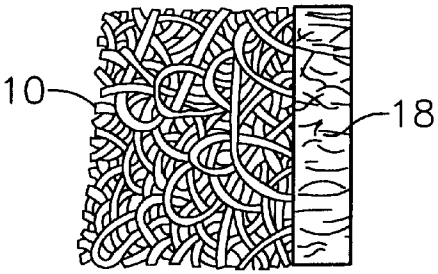
FIG. 3 is a plan view of the FIG. 2 section.
Figure 4:
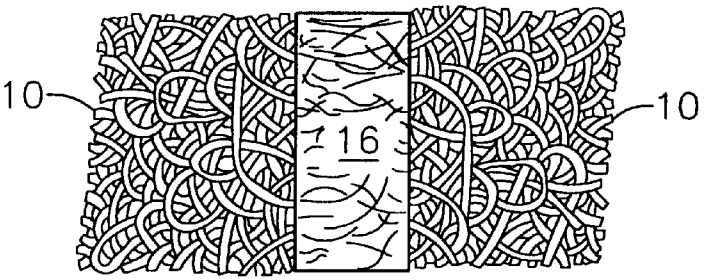
FIG. 4 is a plan view of the FIG. 5 section.

Another invention feature is the fused edge band 18 illustrated by FIGS. 2 and 3. Like the hinge band, localized heat plasticizes the polymer filaments and collapses the mat void volume. Preferably, the edge band is continuous about the entire pad perimeter. A band width of about 1 inch and thickness of about ¼ inch to about ⅜ inch is sufficient. Functionally, this edge band 18 resists snagging and delamination of the filaments along the pad edges.

Figure 13:
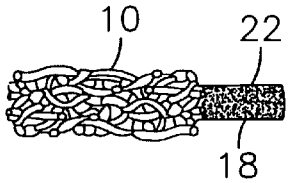
FIG. 13 is an end section of an alternative edge treatment for the invention.
Figure 14:
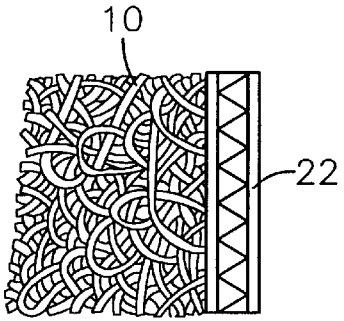
FIG. 14 is a plan view of an alternative edge treatment.

Additional edge protection for the pad may also be provided by an adhesively applied overlay of woven or nonwoven fabric edging 22 as shown by FIGS. 13 and 14. Edge reinforcement of this nature may be applied without edge fusion or in addition to edge fusion. Also, fabric edging 22 may be used as a medium for distinctive design and decoration as shown by FIG. 14. Of course, an overlay edge band 18 may also be secured by traditional stitching.

Figure 16:
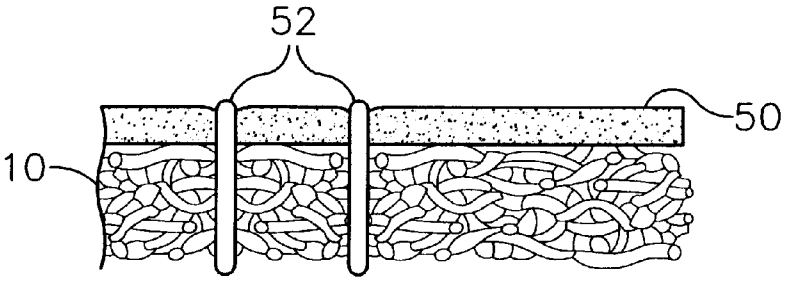
FIG. 16 is a sectional view of an alternative embodiment taken along cutting planes 6—6 of FIG. 15.
Figure 17:
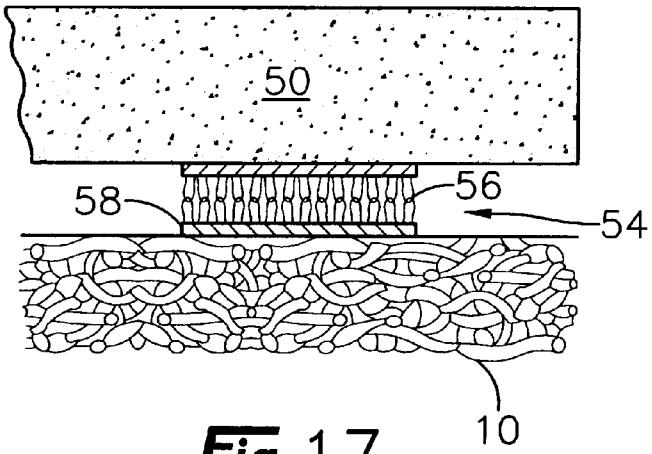
FIG. 17 is a sectional view of another embodiment of the unitized pad.
Figure 15:
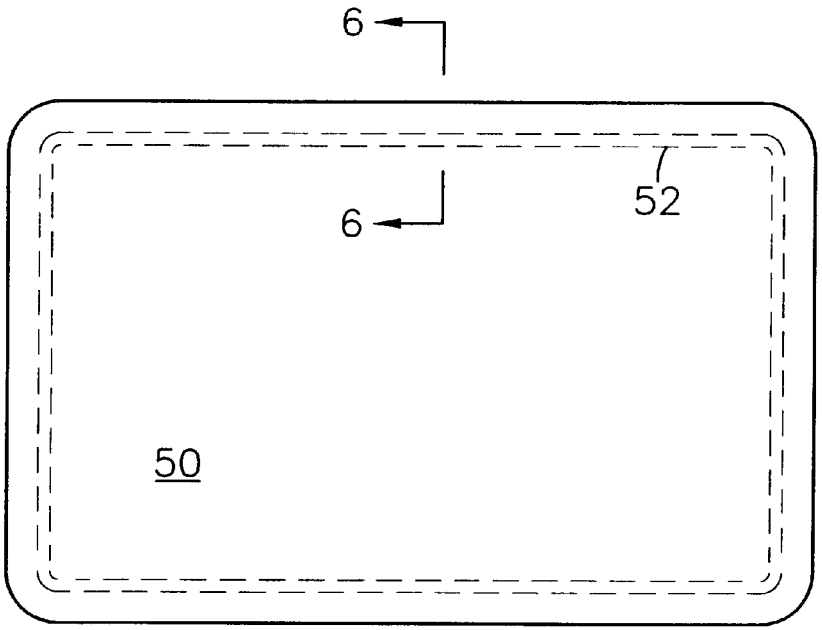
FIG. 15 is a plan view of an alternative embodiment of the invention.

Additional embodiments of the invention are represented by FIGS. 15, 16 and 17. These additional embodiments comprise a unitized assembly of a dissimilar sheet material 50 to a sheet 10 of the pad material previously described. In a simple form, the dissimilar material sheets 10 and 50 are unitized with a double-row stitch line 52 near the edge of the assembly perimeter as shown by FIG. 16. The composition of a suitable stitch thread is, preferably, a synthetic yard such as nylon or rayon.

Suitable dissimilar materials 50 may be almost any thin sheet material. Traditional organic materials, such as felt, woven cotton, woven wool or woven linen, have well known characteristics of dye fastness and texture. Felts may be woven or non-woven of either natural or synthetic materials or a combination.

An unusual material for a top sheet 50 may be a ½ inch to 1 inch thick closed cell foam formed from essentially waterproof neoprene synthetic rubber. When combined with a polymer filament pad 10, moisture drainage channels through the nonabsorptive labyrinth of the pad 10 removes perspiration and weather moisture from under the neoprene top sheet while simultaneously preventing that moisture from wetting tack or other provisions disposed on the horse. Similar results are available from a Gore-Tex® or tightly woven nylon or polyester fabric top sheet 50. Gore Tex®, woven nylon and woven polyester permit a limited degree of gas permeability while simultaneously retarding or preventing transfer of moisture though the dissimilar top sheet 50. Also, neoprene®, Gore Tex®, nylon and polyester are highly resistant to contamination and are easily cleaned and decontaminated in combined assembly with the polymer filament pad 10.

Any of the many suitable dissimilar sheet materials 50 may be unitized with the polymer filament pad 10 by stitching. However, such material sheets may also be unitized by mutually compatible adhesives or by hook and loop pile such as Velcro®. FIG. 17 illustrates the latter example wherein a ¾ inch thickness of closed cell neoprene foam 50 is selectively secured to a ½ inch thick sheet 10 of polymer filament 10 by a perimeter strip of Velcro® 54. Those of ordinary skill in the art will understand that Velcro® is a mechanical fastener comprising first, a band 56 secured by stitching or adhesive to one substrate such as the foam sheet 50, for example. The first Velcro® band is a standing pile of looped filaments. To the other substrate, the polymer filament pad 10, for example, a second Velcro® band 58 is secured by stitching or adhesive. This second Velcro® band 58 also comprises a standing pile of looped filaments wherein the filament loops are severed to form hooks. The filament materials are selected for rigidity and resilience. Nylon, rayon, bronze and stainless steel filaments have been used. When the respective piles of the two Velcro® bands are contiguously joined, many of the resilient hooks of band 58 enter the closed loops of band 56. Force is required to separate the two bands, due to the necessity of straining each hook to extract it from a loop.

With respect to the particular pad styles, traditional western styles 20 of FIG. 7 are preferably, but not exclusively, rectangles of about 30 inches by about 34 inches. Continental or English styles 30 as shown by FIG. 9 are rounded tri-points of about 22 inches along the hinge band 16 and about 32 inches transverse of the hinge band. Spanish styles 40 of FIG. 11 are distinctive from the continental styles by a forecenter notch 42 for consistency with the characteristics of the Spanish saddle construction style. Overall, along the hinge band axis, the Spanish pad 40 is preferably about 23 inches long and about 34 inches transversely across the hinge band 16.

Figure 12:
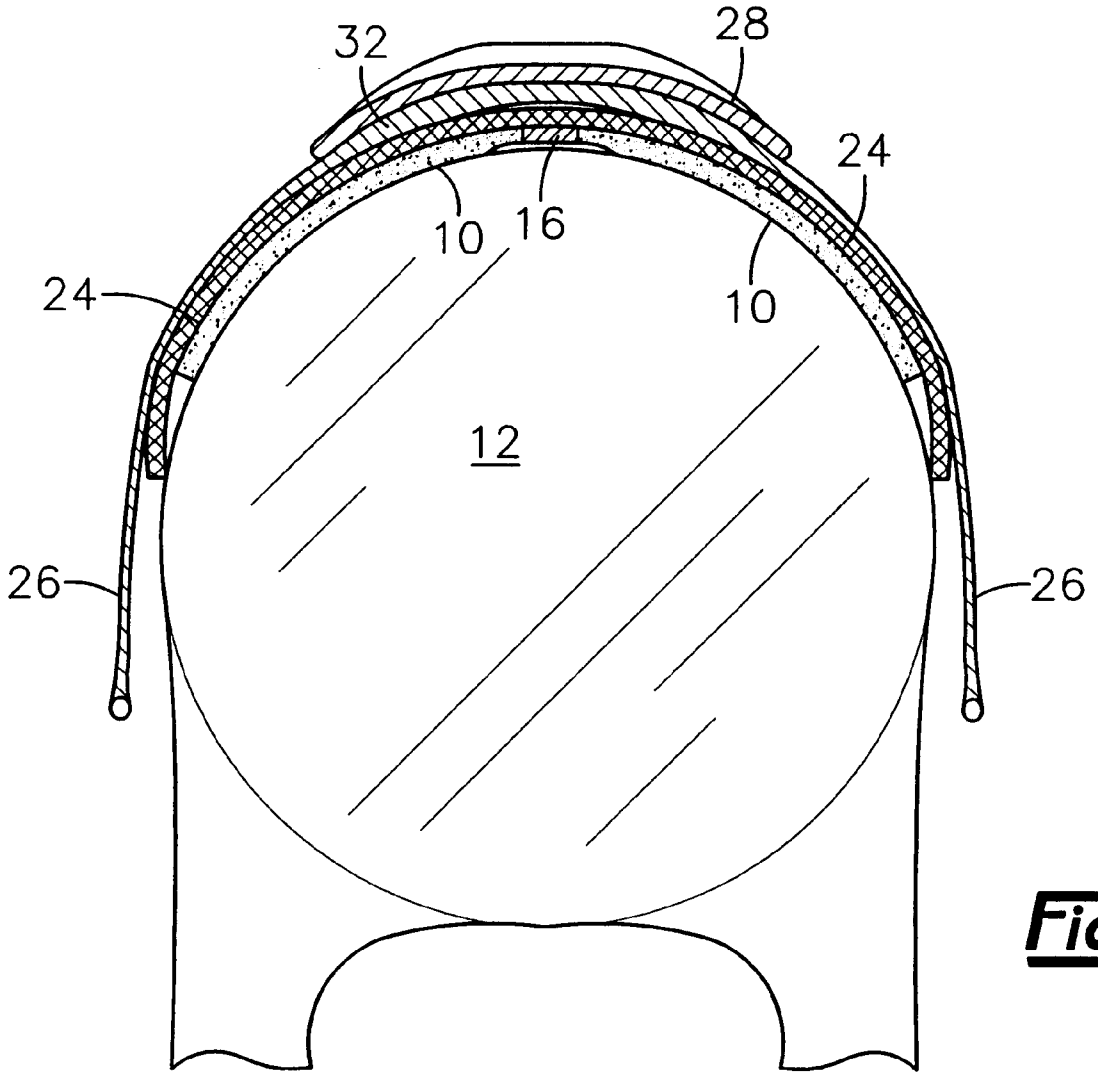
FIG. 12 is a cross-section of the invention in assembly with a horse, saddle and saddle blanket.

The cross-sectional diagram of FIG. 12 illustrates the invention in a preferred combination with the smoother surface of the pad 10 laid contiguously with the horse's back. Over the pad 10 a traditional, lightweight wool or cotton saddle blanket is draped as wear and abrasion protection for the pad 10. Many riders will desire the blanket to extend below the pad 10 for protection of the horse's side from chaffing by stirrup straps.

The saddle 28 is preferably secured over the blanket 24. It will be understood, however, by those knowledgeable of the art, that a saddle blanket 24 is not essential to an adequate combination. Many, better quality production and custom saddles are constructed with an underside surface of unsheared raw wool 32. Except for extended stirrup strap protection, an unsheared wool underside on the saddle will serve essentially the same function as the traditional saddle blanket 24. Accordingly, a saddle with a wool fleece underlining may be thrown over the saddle pad 10 in direct contact with the upper surface of the pad.

Although most equestrians choose to ride with saddles, bareback riders will find the present invention to their liking. In this respect, the invention is functionally superior to a single blanket as with Native American style riding. The present invention offers greater rider comfort due to padding and adhesion. Simultaneously, the rider retains an intimate feel of the animal's muscular structure and temperament.

In use, notice has been taken that a horse ridden with the subject saddle pad does not lather as greatly for the same work indicating a cooler and more comfortable animal. Perspiration drains directly from the horse's hide and hair without being wicked into the saddle leather or absorbed by the blanket. Being of an inorganic source, the polymer filaments of the pad 10 do not absorb water. Moreover, such materials transport moisture by wicking only slightly! Consequently, the saddle, saddle bags, stirrup strapping and other tack remains dry from perspiration. At the end of a ride, the present invention pad may be easily rinsed by a water hose, or flushed in a tank, creek or lake. For greater sanitation, the pad 10 may be washed in detergents, fungicides or biocides. After washing or rinsing, because the polymer filaments per se do not absorb water, the open void volume drains and air dries quickly. Finally, since the polymer is not a nutrient for fungus or bacteria, colony growth has no support from the basic material. When maintained by a reasonable sanitation discipline to remove foreign material of a nutrient character, the pad 10 remains clean and odor-free.

The foregoing description of the invention preferred embodiments has been presented for purposes of illustration and description. It is not intended to be exhaustive or to limit the invention to the precise forms and dimensions disclosed. Obvious modifications or variations are possible in light of the foregoing teachings. These embodiments were chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. An equine saddle pad comprising a continuous sheet of material having a thickness of about ½ inch, a length of less than about 36 inches and a width of less than about 30 inches, said material being a nonwoven mat of extruded polymeric filaments having a diameter of about 10 mil to about 30 mil combined in a randomly piled accumulation of about 65% to about 80% void volume and bonded by heat fusion at filament contact points.

2. A saddle pad as described by claim 1 wherein said filaments are polyvinyl chloride drawn to a diameter of about 10 mil to about 30 mil.

3. A saddle pad as described by claim 1 having a substantially central hinge band connecting lateral leaf portions, said hinge band being a continuously integral material portion of said leaf portions but of substantially reduced thickness and void volume.

4. A saddle pad as described by claim 3 wherein said hinge band is about ½ inch to about 2 inches wide, and about ¼ inch to about ⅜ inch thick.

5. A saddle pad as described by claim 1 having a materially integral perimeter band of substantially reduced thickness and void volume.

6. A saddle pad as described by claim 5 wherein said perimeter band is about 1 inch wide and about ¼ inch to about ⅜ inch thick.

7. A saddle pad as described by claim 5 wherein said perimeter band is overlaid by a fabric edge band secured to said perimeter band.

8. An equine saddle pad comprising a unitized assembly of dissimilar material sheets, a first of said sheets being a nonwoven mat of extruded polymeric filaments having a diameter of about 10 mil to about 30 mil, said filaments being combined in a randomly piled accumulation of about ½ inch thickness with a void volume of about 65% to about 80%, and being bonded by heat fusion at filament contact points.

9. A saddle pad as described by claim 8 wherein the polymeric filaments of said first sheet are polyvinyl chloride drawn to a diameter of about 10 mil to about 30 mil.

10. A saddle pad as described by claim 8 where a second of said dissimilar material sheets is selected from the group comprising neoprene, woven nylon, woven polyester and felt.

11. A saddle pad as described by claim 8 wherein a second of said dissimilar material sheets comprises closed cell foam neoprene having a sheet thickness of about ½ inch to about 1 inch.

12. A saddle pad as described by claim 8 where said dissimilar material sheets are unitized by stitching about a perimeter common to said sheets.

13. A saddle pad as described by claim 8 wherein said dissimilar material sheets are unitized by a hook and loop pile.

14. A saddle pad as described by claim 8 wherein said dissimilar materils are unitized by adhesive.

* * * * *